US008040303B2

(12) United States Patent
Kim et al.

(10) Patent No.: US 8,040,303 B2
(45) Date of Patent: Oct. 18, 2011

(54) ORGANIC LIGHT EMITTING DISPLAY

(75) Inventors: Hyung-Soo Kim, Yongin-si (KR); Wang-Jo Lee, Yongin-si (KR); Bo-Yong Chung, Yongin-si (KR); Sang-Moo Choi, Yongin-si (KR)

(73) Assignee: Samsung Mobile Display Co., Ltd., Giheung-Gu, Yongin, Gyunggi-Do (KR)

( * ) Notice: Subject to any disclaimer, the term of this patent is extended or adjusted under 35 U.S.C. 154(b) by 1207 days.

(21) Appl. No.: 11/790,656

(22) Filed: Apr. 26, 2007

(65) Prior Publication Data

US 2008/0150847 A1 Jun. 26, 2008

(30) Foreign Application Priority Data

Dec. 21, 2006 (KR) ..... 10-2006-0131961

(51) Int. Cl.
*G09G 3/32* (2006.01)

(52) U.S. Cl. ..... 345/82; 345/76; 345/83; 345/204; 345/211; 345/212

(58) Field of Classification Search ..... 345/76, 345/77, 80, 82, 83, 84, 204, 211, 212, 214, 345/690; 315/160, 167, 169.1, 169.3
See application file for complete search history.

(56) References Cited

U.S. PATENT DOCUMENTS

| | | | | |
|---|---|---|---|---|
| 7,327,357 | B2 * | 2/2008 | Jeong | 345/204 |
| 7,329,849 | B2 * | 2/2008 | Kasai | 250/214 R |
| 2005/0062686 | A1 | 3/2005 | Iguchi | |
| 2006/0077138 | A1 * | 4/2006 | Kim | 345/76 |
| 2006/0077194 | A1 * | 4/2006 | Jeong | 345/204 |
| 2006/0231740 | A1 * | 10/2006 | Kasai | 250/214.1 |
| 2006/0244695 | A1 | 11/2006 | Komiya | |
| 2007/0040770 | A1 * | 2/2007 | Kim | 345/76 |
| 2008/0169460 | A1 * | 7/2008 | Yoo | 257/40 |
| 2008/0169754 | A1 | 7/2008 | Yang et al. | |

FOREIGN PATENT DOCUMENTS

| | | |
|---|---|---|
| JP | 2003-150108 | 5/2003 |
| JP | 2003-295824 | 10/2003 |
| JP | 2004-325885 | 11/2004 |
| JP | 2004-361737 | 12/2004 |
| JP | 2005-017438 | 1/2005 |
| JP | 2005-084119 | 3/2005 |

(Continued)

*Primary Examiner* — My-Chau T Tran
(74) *Attorney, Agent, or Firm* — Robert E. Bushnell, Esq.

(57) ABSTRACT

An organic light emitting display, suitable for a high quality and high resolution display device, rapidly charges a data voltage using a voltage programming technique, after compensating for a deviations in the threshold voltage and mobility of a driving transistor using a current programming technique. The organic light emitting display includes: a data line supplying a data signal; a scan line supplying a scan signal; a first switching element, electrically coupling its control electrode to the scan line, transferring the data signal supplied from the data line; a driving transistor, electrically coupling its control electrode to the first switching element, controlling a driving current of a first voltage line; a first capacitive element electrically coupled between the first switching element and the control electrode of the driving transistor; an Organic Light Emitting Diode (OLED), electrically coupled between the driving transistor and a second power voltage line, displaying an image by a current supplied from the driving transistor; and a fourth switching element compensating for deviations of characteristics of the driving transistor by supplying a current of the first current line to the driving transistor.

22 Claims, 6 Drawing Sheets

FOREIGN PATENT DOCUMENTS

| | | |
|---|---|---|
| JP | 2006-280585 | 10/2006 |
| KR | 10-2002-0067678 | 8/2002 |
| KR | 10-2004-0008684 | 1/2004 |
| KR | 10-2004-0009285 | 1/2004 |
| KR | 10-2004-0033679 | 4/2004 |
| KR | 10-2004-0107047 | 12/2004 |
| KR | 10-2005-0085053 | 8/2005 |
| KR | 10-2005-0123328 | 12/2005 |
| KR | 10-2006-0017207 | 2/2006 |
| KR | 10-2006-0065168 | 6/2006 |
| KR | 10-2006-0114456 | 11/2006 |
| KR | 10-2008-0003240 | 1/2008 |

* cited by examiner

ORGANIC LIGHT EMITTING DISPLAY

CLAIM FOR PRIORITY

This application makes reference to, incorporates the same herein, and claims all benefits accruing under 35 U.S.C.§119 from an application for ORGANIC LIGHT EMITTING DISPLAY earlier filed in the Korean Intellectual Property Office on 21 Dec. 2006 and there duly assigned Serial No. 10-2006-0131961.

BACKGROUND OF THE INVENTION

1. Field of the Invention

The present invention relates to an organic light emitting display, and more particularly, the present invention relates to an organic light emitting display suitable for a high quality and high resolution display device, by rapidly charging a data voltage using a voltage programming technique, after compensating for deviations, such as a threshold voltage and a mobility of a driving transistor, using a current programming technique.

2. Description of the Related Art

Generally, a conventional organic light emitting display electrically excites a phosphor or a phosphorescent organic compound and emits light, which displays an image by driving N×M organic emitting cells. The organic light emitting cell of FIG. 1 includes an anode of Indium Tin Oxide (ITO), an organic thin film and a cathode (metal). The organic thin film is a multilayer structure including an EMitting Layer (EML), an Electron Transport Layer (ETL) and a Hole Transport Layer (HTL), and may further include an extra Electron Injection Layer (EIL) and Hole Injection Layer (HIL).

Techniques for driving the organic light emitting cell include a simple matrix technique and an active matrix technique using a Thin Film Transistor (TFT) or a MOSFET. The simple matrix technique drives a light emitting cell by forming an anode to intersect with a cathode and selecting a line. The active matrix technique connects the TFT and a capacitor to respective Indium Tin Oxide (ITO) pixel electrodes to maintain a voltage by the capacity of a capacitor. The active matrix technique is divided into a voltage programming technique and a current programming technique according to the form of a signal supplied to the capacitor for maintaining the voltage.

Organic light emitting displays using voltage and current programming techniques are respectively explained below with reference to FIGS. 2 and 3.

FIG. 2 is a pixel circuit of a voltage programming technique for driving an Organic Light Emitting Diode (OLED) and representatively illustrates one of N×M pixel circuits.

Referring to FIG. 2, a driving transistor (M1) is coupled to the OLED so as to supply a light-emitting current. The amount of current of the driving transistor (M1) is controlled by a data voltage supplied through a first switching element (S1). A first capacitive element (C1) for maintaining the supplied voltage for a fixed period of time is coupled between a gate and a source of the driving transistor (M1). A first electrode of the first switching element (S1) is coupled to a data line (Data[m]), and a control electrode thereof is coupled to a scan line (Scan [n]).

When the first switching element (S1) is turned on by a scan signal supplied to the control electrode of the first switching element (S1), a data voltage is supplied from the data line (Data[m]) to the control electrode of the driving transistor (M1). As a result thereof, a current ($I_{OLED}$) corresponding to a voltage ($V_{GS}$) charged between the gate and the source of the driving transistor (M1) by the first capacitive element (C1) flows to the drain of the driving transistor (M1) and the OLED emits light according to the current ($I_{OLED}$).

The current flowing to the OLED is obtained by Equation 1.

$$I_{OLED} = \frac{\beta}{2}(V_{GS} - V_{TH})^2 = \frac{\beta}{2}(V_{SG} - |V_{TH}|)^2 = \frac{\beta}{2}(V_{DD} - V_{DATA} - |V_{TH}|)^2 \quad \text{Equation 1}$$

In Equation I, $I_{OLED}$ is a current flowing to the OLED, $V_{GS}$ is a voltage between the gate and the source of the driving transistor (M1), and a $V_{TH}$ is a threshold voltage of the driving transistor (M1), a $V_{DATA}$ is a data voltage, and β is a constant.

As shown in Equation 1, according to the pixel circuit shown in FIG. 2, the current corresponding to the supplied data voltage is supplied to the OLED, and the OLED emits light corresponding to the supplied current.

In the pixel circuit of the voltage programming technique discussed above, the luminance is non-uniform due to deviations in mobility and threshold voltage of a TFT caused by non-uniformities in the manufacturing process.

On the contrary, the pixel circuit of the current programming technique may obtain a uniform display characteristic, even though the driving transistor in the respective pixels has a non-uniform voltage-current characteristic, if a current source supplying a current to the pixel circuit is uniform on all of the data lines.

FIG. 3 is a pixel circuit of a current programming technique for driving the OLED, and representatively illustrates one of N×M pixel circuits.

Referring to FIG. 3, the driving transistor (M1) is coupled to the OLED so as to supply a light-emitting current, and the amount of current of the driving transistor (M1) is controlled by a data current supplied through the first switching element (S1).

When the first and second switching elements (S1 and S2) are turned on due to a selection signal outputted from the scan line (Scan [n]), the driving transistor (M1) is connected in a diode configuration, a voltage corresponding to a data current ($I_{DATA}$) from the data line (Data [m]) is stored in the first capacitive element (C1), the current ($I_{OLED}$) corresponding to the voltage stored in the first capacitive element (C1) flows to the drain of the driving transistor (M1), and the OLED emits light corresponding to the current ($I_{OLED}$). The current flowing to the OLED is obtained by Equation 2.

$$I_{OLED} = \frac{\beta}{2}(V_{GS} - V_{TH})^2 = I_{DATA} \quad \text{Equation 2}$$

In Equation 2, $I_{OLED}$ is a current flowing to the OLED, $V_{GS}$ is a voltage between the gate and the source of the driving transistor (M1), $V_{TH}$ is a threshold voltage of the driving transistor (M1), $I_{DATA}$ is a data current, and β is a constant.

As shown in Equation 2, in accordance with the current programming pixel circuit discussed above, the current ($I_{OLED}$) flowing to the OLED is the same as the data current ($I_{DATA}$), so that a programming current source may obtain a uniform characteristic on all of the panels. However, the current ($I_{OLED}$) flowing to the OLED is a minute current, and the pixel circuit is controlled by the minute current ($I_{DATA}$), so that it has a problem in that it takes a considerable amount of time to charge the data line. For example, if a load capacitance of the data line is 30 pF, several milliseconds are needed to charge a load of the data line with a data current of several tens to several hundreds of nA. Therefore, there is a problem in that there is not sufficient time to charge the load of the data line, considering a line time of several tens of μs.

SUMMARY OF THE INVENTION

Accordingly, an object of the present invention is to provide an organic light emitting display that can be suitable for a high quality and high resolution display by rapidly charging a data voltage using a voltage programming technique, after compensating for deviations, such as the threshold and mobility of the driving transistors, using a current programming technique.

According to an aspect of the present invention, an organic light emitting display is provided including: a data line supplying a data signal; a scan line supplying a scan signal; a first switching element, electrically coupling its control electrode to the scan line, transmitting a data signal supplied from the data line; a driving transistor, electrically coupling its control electrode to the first switching element, controlling a driving current of a first power voltage line; a first capacitive element electrically coupled between the first switching element and the control electrode of the driving transistor; an Organic Light Emitting Diode (OLED), electrically coupled between the driving transistor and a second power voltage line, displaying an image by a current supplied from the driving transistor; and a fourth switching element supplying a current of a first current line to the driving transistor and compensating for deviations in characteristics of the driving transistor.

A first electrode of the fourth switching element may be electrically coupled to the first current line, and a second electrode thereof may be electrically coupled between the driving transistor and the OLED.

The organic light emitting display may be operated by supplying a current from a first current source by turning on the fourth switching element and compensating for the deviations in characteristics of the driving transistor, and then programming a data voltage to the first capacitive element by turning the first switching element.

The organic light emitting display may further include a third switching element supplying a voltage of the first power voltage line to the first capacitive element, a second switching element coupled to the driving transistor connected in a diode configuration, and a fifth switching element transmitting the current supplied from the driving transistor to the OLED.

A first electrode of the third switching element may be electrically coupled to the first power voltage line, and a second electrode thereof may be electrically coupled between the first switching element and the first capacitive element. A first electrode of the second switching element may electrically coupled between the control electrode of the driving transistor and the first capacitive element, and a second electrode thereof may be electrically coupled between the driving transistor and the fourth switching element. A first electrode of the fifth switching element may be electrically coupled between the driving transistor and the fourth switching element, and a second electrode may be electrically coupled to the OLED.

Control electrodes of the second to the fourth switching elements may be coupled to a direct scan line, and a control electrode of the fifth switching element may be coupled to a light emitting control line.

The first to the fifth switching elements and the driving transistor may each be P-channel transistors.

For a compensation period in an image display period of one frame, if the second to the fourth switching elements are turned on, and the first and fifth switching elements are turned off, the current from the first current line is supplied to the driving transistor, so that deviations in characteristics of the driving transistor may be compensated for.

For a programming period in the image display period of one frame, if the first switching element is turned on, the second to the fifth switching elements are turned off, a data voltage from the data line may be supplied to a first electrode of the first capacitive element.

For a light emitting period in the image display period of one frame, if the fifth switching element is turned on, and the first to the fourth switching elements are turned off, the voltage stored in the first capacitive element is supplied to the organic light emitting diode so as to emit light.

The organic light emitting display may further include a second capacitive element whose a first electrode is electrically coupled between the first power voltage line and the first electrode of the third switching element, and a second electrode is electrically coupled between the first capacitive element and the control electrode of the driving transistor.

Control electrodes of the second to the fourth switching elements are coupled to a direct scan line, and a control electrode of the fifth switching element may be coupled to a light emitting control line.

The organic light emitting display may further include a second capacitive element whose a first electrode is electrically coupled between the first power voltage line and the first electrode of the third switching element, and a second electrode is electrically coupled between the first capacitive element and the second electrode of the third switching element.

The organic light emitting display compensates for deviations in characteristics of the driving transistor by programming a data voltage and causing a fixed volume of current to flow to the driving transistor prior to driving.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
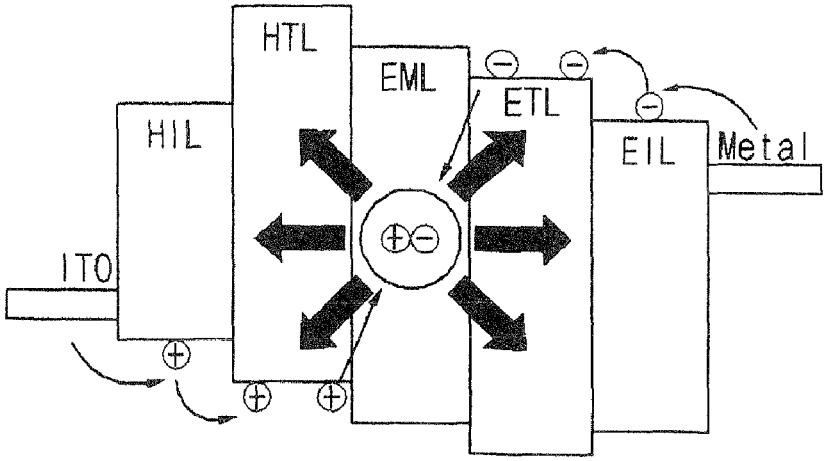
FIG. 1 (Prior Art)
FIG. 1 is a conceptual diagram of an organic light emitting diode.
Figure 2:
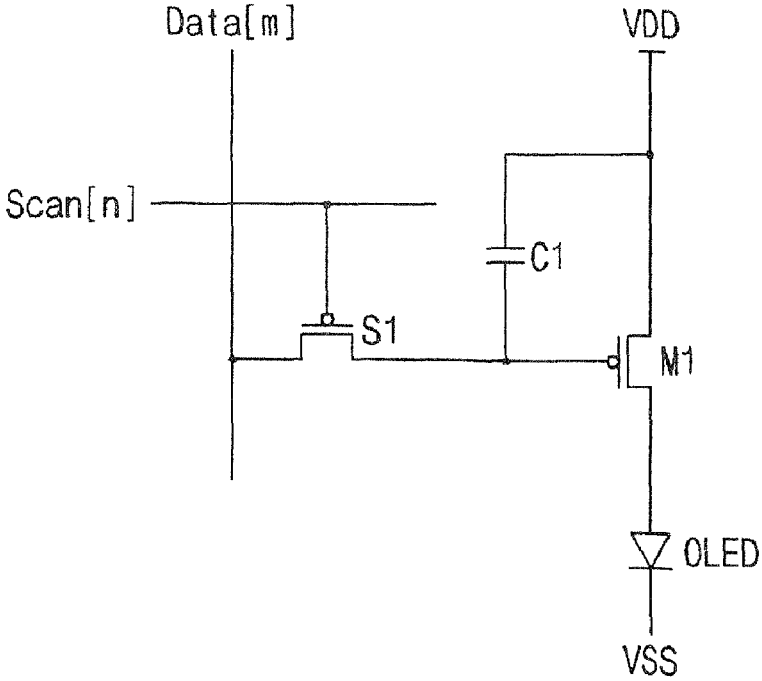
FIG. 2 (Prior Art)
FIG. 2 is a pixel circuit diagram of a voltage programming technique.

Hereinafter, exemplary embodiments of the present invention are described in detail with reference to the accompanying drawing. The aspects and features of the present invention and methods for achieving the aspects and features will be apparent by referring to the embodiments to be described in detail with reference to the accompanying drawings. However, the present invention is not limited to the embodiments disclosed hereinafter, but can be implemented in diverse forms. The matters defined in the description, such as the detailed construction and elements, are merely specific details provided to assist those of ordinary skill in the art in a comprehensive understanding of the present invention, and the present invention is only defined within the scope of the appended claims. In the entire description of the present invention, the same drawing reference numerals are used for the same elements across various figures.

Figure 4:
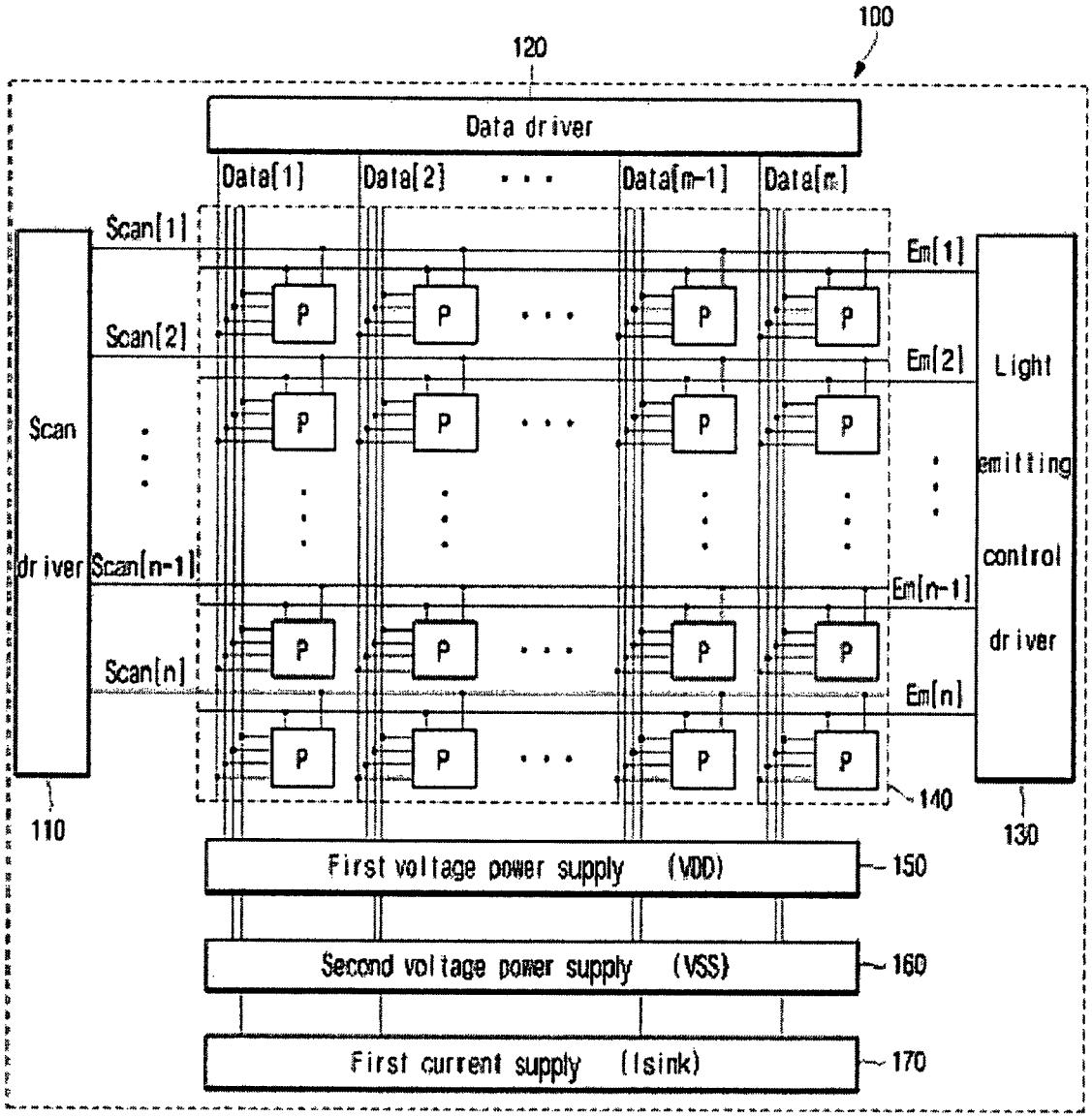
FIG. 4 is a schematic diagram of an organic light emitting display according to an embodiment of the present invention.

FIG. 4 is a block diagram of an organic light emitting display according to an embodiment of the present invention.

Referring to FIG. 4, a flat panel display 100 includes a scan driver 110, a data driver 120, a light emitting control driver 130, an organic light emitting display panel (hereinafter, referred to as the "panel") 140, a first voltage power supply 150, a second voltage power supply 160 and a first current supply 170.

The scan driver 110 sequentially supplies a scan signal to the panel 140 through a plurality of scan lines (Scan[1], Scan[2], . . . , and Scan[n]).

The data driver 120 supplies a data signal to the panel 140 through a plurality of data lines (Data[1], Data[2], . . . , and Data[m]).

The light emitting control driver 130 sequentially supplies a light emitting control signal to the panel 140 through a plurality of light emitting control lines (Em[1], Em[2], . . . , and Em[n]).

The panel 140 includes the plurality of scan lines (Scan[1], Scan[2], . . . , and Scan[n]) and the plurality of light emitting control lines (Em[1], Em[2], . . . , and Em[n] that are arranged in a column direction, the plurality of data lines (Data[1], Data[2], . . . , and Data[m]) arranged in a row direction, and a pixel circuit 141 defined by the plurality of scan lines (Scan [1], Scan[2], . . . , and Scan[n]), the plurality of data lines (Data[1], Data[2], . . . , and Data[m]) and the plurality of light emitting control lines (Em[1], Em[2], . . . , and Em[n]).

The pixel circuit is formed in a pixel region defined by two adjacent scan lines (or light emitting control lines) and two adjacent data lines. As described above, the scan signal is supplied by the scan driver 1 10 to the plurality of scan lines (Scan[ 1], Scan[2], . . . , and Scan[n]), a data signal is supplied by the data driver 120 to the plurality of data lines (Data[1], Data[2], . . . , and Data[m]), and the light emitting control signal is supplied by the light emitting control driver 130 to the plurality of light emitting control lines (Em[1], Em[2], . . . , and Em[n]).

The first and second voltage power supplies 150 and 160 supply first and second power supply voltages to respective pixel circuits 141 on the panel 140, and the first current supplier 170 supplies a first current to respective pixel circuits 141 on the panel 140.

Figure 5:
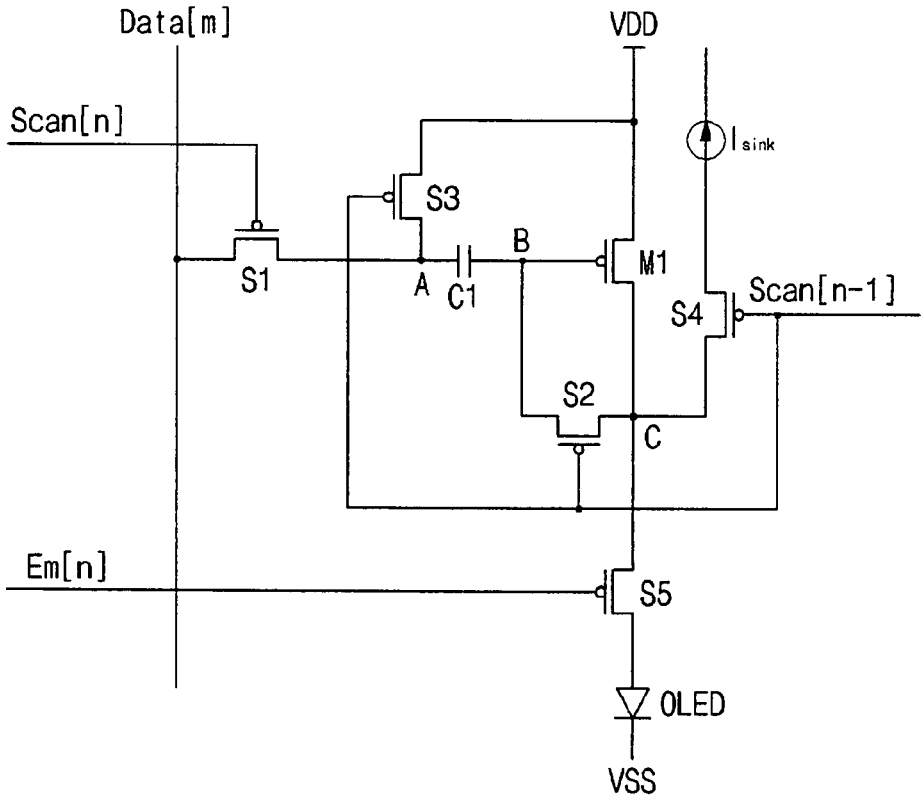
FIG. 5 is a circuit diagram of a pixel circuit of an organic light emitting display according to one exemplary embodiment of the present invention.

FIG. 5 is a circuit diagram of a pixel circuit of an organic light emitting display according to one exemplary embodiment of the present invention. The following pixel circuits denote one pixel circuit of the flat panel display 100 of FIG. 4.

Referring to FIG. 5, the pixel circuit of the organic light emitting display includes a scan line (Scan[n]), a direct scan line (Scan[n-1]), a data line (Data[m]), a light emitting control line (Em[n]), a first power supply voltage line ($V_{DD}$), a second power supply voltage line (VSS), a first current line ($I_{sink}$), a driving transistor (M1), a first switching element (S1), a second switching element (S2), a third switching element (S3), a fourth switching element (S4), a fifth switching element (S5), a first capacitive element (C1) and an Organic Light Emitting Diode (OLED).

The scan line (Scan[n]) supplies a scan signal for selecting an OLED to be driven to a control electrode of the first switching element (S1). The scan line (Scan[n]) is electrically coupled to the scan driver 110 (see FIG. 4) for generating a scan signal.

The direct scan line (Scan[n-1]) is indicated as Scan[n-1] since a previously selected (n-1)th scan line is commonly coupled and used. The direct scan line (Scan[n-1]) controls the operation of the second to fourth switching elements S2, S3 and S4.

The data line (Data[m]) supplies a data signal (voltage) in proportion to a light emitting luminance to a first electrode (A) of the first capacitive element (C1). The data line (Data [m]) is electrically coupled to the data driver 120 (referring to FIG. 4) for generating a data signal.

The light emitting control line (Em[n]) is electrically coupled to a control electrode of the fifth switching element (S5), to control a light emitting time of the OLED. The light emitting control line (Em[n]) is electrically coupled to the light emitting control driver 130 (referring to FIG. 4) for generating a light emitting control signal.

The first power supply voltage line ($V_{DD}$) enables the first power supply voltage to be supplied to the OLED. The first power supply voltage line ($V_{DD}$) is coupled to the first voltage power supply 150 (see FIG. 4) for supplying the first power supply voltage.

The second power supply voltage line (VSS) enables a second power supply voltage to be supplied to the OLED. The second power supply voltage line (VSS) is coupled to the second voltage power supply 160 (see FIG. 4) for supplying the second power supply voltage. The first power supply voltage may be at a higher voltage level than the second power supply voltage.

Figure 3:
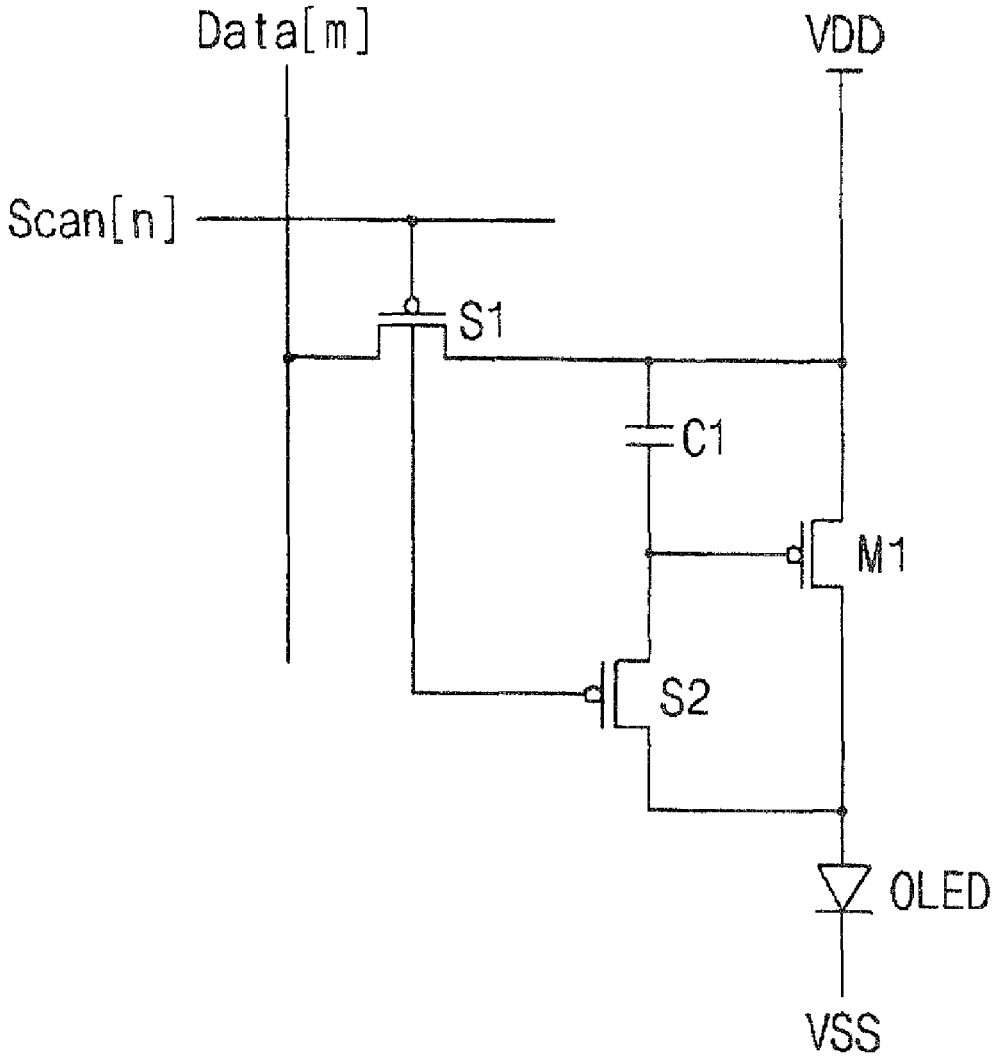
FIG. 3 (Prior Art)
FIG. 3 is a pixel circuit diagram of a current programming technique.

The first current line ($I_{sink}$) enables a first current to be supplied to the driving transistor (M1). When the fourth switching element (S4) is turned on, a current is supplied to the driving transistor (M1), so that deviations in mobility and threshold of the driving transistors (M1) of respective pixel circuits 141 (see FIG. 4) are compensated for, in the same fashion as the current programming technique of FIG. 3. The first current line ($I_{sink}$) is coupled to the first current supply 170 (see FIG. 4) for supplying a first current.

The driving transistor (M1) includes a first electrode electrically coupled to the first power supply voltage line ($V_{DD}$), a second electrode electrically coupled to a first electrode of the fifth switching element (S5) and a second electrode of the fourth switching element (S4), and a control electrode electrically coupled to a second electrode of the first switching element (S1). The driving transistor (M1) (assumed to be a P-channel transistor) is turned on if a data signal at a low level (or a negative voltage) is supplied through the control electrode, and supplies a fixed voltage from the first power supply voltage line ($V_{DD}$) to the OLED. A first capacitive element (C1) is charged by supplying a data signal of a high level (or a positive voltage) to a first electrode (A) thereof. As a result thereof, even though the first switching element (S1) is turned off, the data signal at a high level (or a positive voltage) is continuously supplied to the control electrode of the driving transistor (M1) by the voltage charged in the first capacitive element (C1) for a fixed time.

The driving transistor (M1) may be an amorphous silicon TFT, a polysilicon TFT, an organic TFT, a nano thin film semiconductor transistor or equivalents thereof. However, the present invention is not limited thereto.

If the driving transistor (M1) is the polysilicon TFT, it may be formed by laser crystallization, metal induced crystallization, high voltage crystallization or equivalents thereof However, the present invention is not limited thereto.

Laser crystallization is a method of crystallizing an amorphous silicon with an excimer laser, for example. Metal induced crystallization is a method including positioning a metal, for example, adjacent to an amorphous silicon and starting crystallization from the metal by applying a predetermined temperature. Furthermore, high voltage crystallization is a method of crystallizing amorphous silicon, for example, by applying a predetermined voltage to the amorphous silicon.

If the driving transistor (M1) is manufactured by the metal induced crystallization, the driving transistor (M1) further includes a metal selected from a group consisting of nickel (Ni), cadmium (Cd), cobalt (Co), Titanium (Ti), palladium (Pd), tungsten (W) or equivalents thereof.

The first switching element (S1) includes a first electrode (a drain electrode or a source electrode) electrically coupled to the data line (Data[m]), a second electrode (a source electrode or a drain electrode) electrically coupled to a control electrode (a gate electrode) of the driving transistor (M1), and a control electrode electrically coupled to the scan line (Scan [n]). When the first switching element (S1) is turned on, a data signal is supplied to the first electrode (A) of the first capacitive element (C1).

The second switching element (S2) includes a first electrode electrically coupled to the control electrode of the driving transistor (M1), and a second electrode electrically coupled between the second electrode of the driving transistor (M1) and the first electrode of the fifth switching element (S5). When a scan signal of a low level is supplied to the control electrode through the direct scan line (Scan[n-1]), the fifth switching element (S5) is turned on and is connected in a diode configuration.

The third switching element (S3) includes a first electrode electrically coupled to the first power supply voltage line ($V_{DD}$), and a second electrode electrically coupled to the first electrode (A) of the first capacitive element (C1). When a scan signal at a low level is supplied to a control electrode through the direct scan line (Scan[n-1]), the third switching element (S3) is turned on, thereby supplying the first power supply voltage ($V_{DD}$) to a node A of the first capacitive element (C1).

The fourth switching element (S4) includes a first electrode (a source electrode or a drain electrode) electrically coupled to the first current line ($I_{sink}$), and a second electrode (a drain electrode or a source electrode) electrically coupled between the second electrode of the driving transistor (M1) and the second switching element (S2). When a scan signal of a low level is supplied to the control electrode through the direct scan line (Scan [n-1]), the fourth switching element (S4) is turned on, thereby supplying a first current of the first current line ($I_{sink}$) to the driving transistor (M1).

The fifth switching element (S5) includes a first electrode electrically coupled to the second electrode of the driving transistor (M1), and a second electrode electrically coupled to an anode of the OLED. When a scan signal at a low level is supplied to the control electrode through the light emitting control line (Em[n]), the fifth switching element (S5) is turned on, thereby causing a current to flow from the driving transistor (M1) to the OLED.

The first capacitive element (C1) includes a first electrode (A) electrically coupled between the second electrode of the first switching element (S1) and the third switching element (S3), and a second electrode (B) electrically coupled between the control electrode of the driving transistor (M1) and the first electrode of the second switching element (S2).

The OLED includes an anode electrically coupled to the second electrode of the fifth switching element (S5), and a cathode electrically coupled to a second power supply voltage line (VSS). The OLED emits light at a predetermined luminance by the current controlled through the driving transistor (M1).

The OLED is equipped with a light emitting layer (hereinafter, referred to as "EML", see FIG. 1), and the EML is a material selected from phosphor materials, phosphorescent materials, mixtures thereof or equivalents thereof. However, the present invention is not limited thereto.

Furthermore, the EML may be a material selected from red light emitting materials, green light emitting materials, blue light emitting materials, mixtures thereof or equivalents thereof. However, the present invention is not limited thereto.

Figure 6:
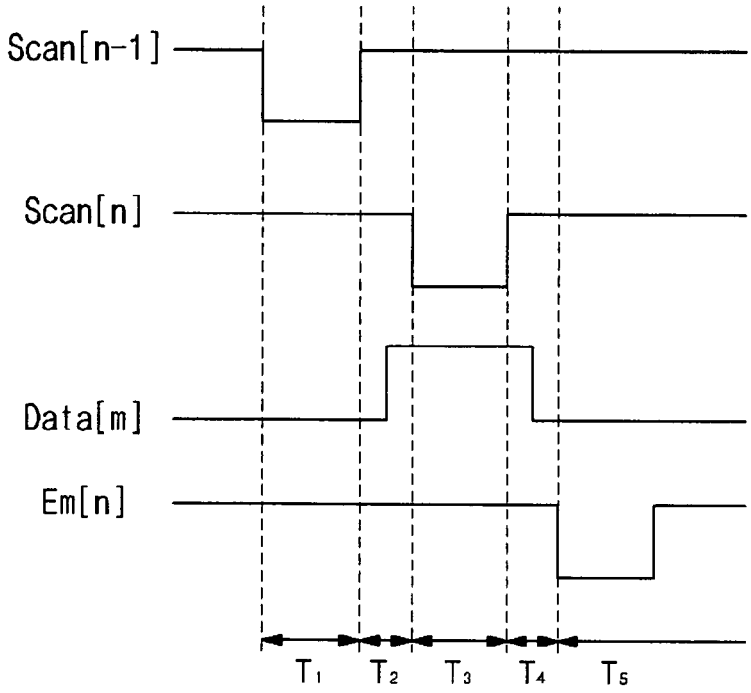
FIG. 6 is a timing diagram of the pixel circuit of FIG. 5.

FIG. 6 is a timing diagram of the organic light emitting display of FIG. 5. The operation of the pixel circuit of the organic light emitting display is as follows.

Referring to FIG. 6, the timing diagram of the organic light emitting display includes a current programming period (T1), a delay period 1 (T2), a programming period (T3), a delay period 2 (T4) and a light emitting period (T5).

For the current programming period (T1), a scan signal of a low level is supplied to the direct scan line (Scan[n-1]), so that the second to the fourth switching elements S2, S3 and S4 are turned on. The second switching element (S2) is turned on, so as to connect the driving transistor in a diode configuration. The third switching element (S3) is turned on, so as to supply a first power supply voltage of the first power supply voltage line to the A node. The fourth switching element (S4) is turned on, so as to cause the first current to flow to the driving transistor (M1). The first current ($I_{sink}$) is obtained by Equation 3.

$$I_{sink} = \frac{\beta}{2}(V_{GS} - V_{TH})^2 = I_{OLED} \qquad \text{Equation 3}$$

$$V_{GS} = \sqrt{\frac{2I_{sink}}{\beta}} + V_{TH}$$

In Equation 3, $V_{GS}$ is a voltage between the gate and the source of the driving transistor, $V_{TH}$ is a threshold voltage of the driving transistor and β is a constant. A voltage value ($V_{GS}$) stored between the gate and the source of the driving transistor (M1), i.e., between A and B nodes, may be estimated by the first current ($I_{sink}$). Furthermore, a current flowing into the drain of the driving transistor, i.e., a current flowing into the OLED is controlled by the first current, so that a desired luminance may be obtained, regardless of deviations in the mobility and threshold of respective driving transistors.

For the delay period 1 (T2), a scan signal of the scan line (Scan[n]) is maintained at a high level, a data voltage ($V_{DATA}$) of the data line (Data[m]) is changed into a data voltage ($V_{DATA}$) corresponding to a pixel circuit coupled to the scan line (Scan[n]). If there is no delay period 1 (T2), when a scan signal of the scan line (Scan[n]) arrives at a low level prior to the supplying of a present data voltage ($V_{DATA}$), a direct data voltage supplied to the data line (Data [m]) is supplied to the driving transistor (M1) through the first switching element (S1).

For the programming period (T3), a scan signal at a low level is supplied to the scan line (Scan[n]), so that the first switching element(S1) is turned on, so as to supply a data signal to the A node. A voltage variation of the voltages (T1→T3) of the A node is obtained by Equation 4.

$$\Delta V_A = V_{DATA} - V_{DD} \quad \text{Equation 4:}$$

In other words, a voltage of the A node is a difference between the voltage ($V_{DATA}$) for the programming period (T3) and the voltage ($V_{DD}$) for the current programming period (T1).

For the delay period 2 (T4), a scan signal of the scan line (Scan[n]) becomes a high level for a fixed time before a light emitting control signal of the light emitting control line (Em [n]) becomes a low level. This is for preventing a delay phenomenon that may occur due to the delay of respective elements in the operation of the pixel circuit.

For the light emitting period (T5), a scan signal at a low level is supplied to the light emitting control line (Em[n]) and then the fifth switching element (S5) is turned on, so that the voltage charged in the first capacitive element, i.e., a current ($I_{OLED}$) corresponding to the gate-source voltage ($V_{GS}$) of the driving transistor (M1) is supplied to the OLED so as to emit light. The current ($I_{OLED}$) is obtained by Equation 5.

$$\begin{aligned} I_{OLED} &= \frac{\beta}{2}(V_{GS} - \Delta V_A - V_{TH})^2 \\ &= \frac{\beta}{2}\left(\sqrt{\frac{2I_{sink}}{\beta}}\ V_{TH} - (V_{DATA} - V_{DD}) - V_{TH}\right)^2 \\ &= \frac{\beta}{2}\left(\sqrt{\frac{2I_{sink}}{\beta}} - V_{DATA} + V_{DD}\right)^2 \end{aligned} \quad \text{Equation 5}$$

In Equation 5, $V_{GS}$ is a voltage between the gate and the source of the driving transistor, $\Delta V_A$ is the variation of voltages of A node, $V_{DATA}$ is a data voltage, $V_{DD}$ is a first power supply voltage and $V_{TH}$ is a threshold voltage of the driving transistor. Referring to Equation 5, the current ($I_{OLED}$) is controlled by the first power supply voltage ($V_{DD}$), the data voltage ($V_{DATA}$) and the first current ($I_{sink}$).

As described above, the driving circuit is a voltage programming technique for compensating for deviations in the mobility and threshold of the driving transistors for the current programming period (T1), programming and driving a data voltage for the programming period (T3). In other words, the deviations in the mobility and threshold of the transistors, i.e., a disadvantage occurring in the voltage programming technique, may be compensated for by first programming the current to the pixel circuit. Furthermore, the pixel circuit is a voltage programming technique programming the data voltage after programming the current to the pixel circuit, thereby reducing the time needed to charge the voltage in the capacitive element generated from the pixel circuit of the current programming technique. In other words, the disadvantages of the voltage programming technique and the current programming technique are obviated.

Figure 7:
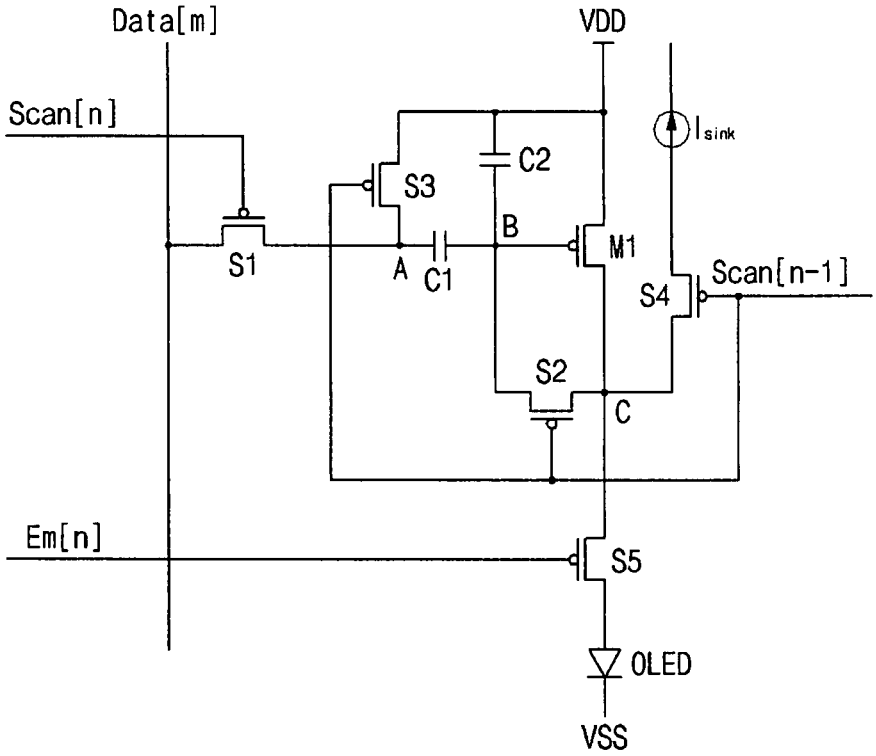
FIG. 7 is a circuit diagram of a pixel circuit of an organic light emitting display according to another exemplary embodiment of the present invention.

FIG. 7 is a circuit diagram of a pixel circuit of an organic light emitting display according to another exemplary embodiment of the present invention. The following pixel circuit corresponds to one pixel circuit of the flat panel display 100 of FIG. 4.

Referring to FIG. 7, the pixel circuit of the organic light emitting display has the same configuration as that of FIG. 5, except for the second capacitive element (C2). The second capacitive element (C2) includes the first electrode electrically coupled between the first power supply voltage line ($V_{DD}$) and the driving transistor (M1), and the second electrode electrically coupled to the control electrode of the driving transistor (M1).

Figure 8:
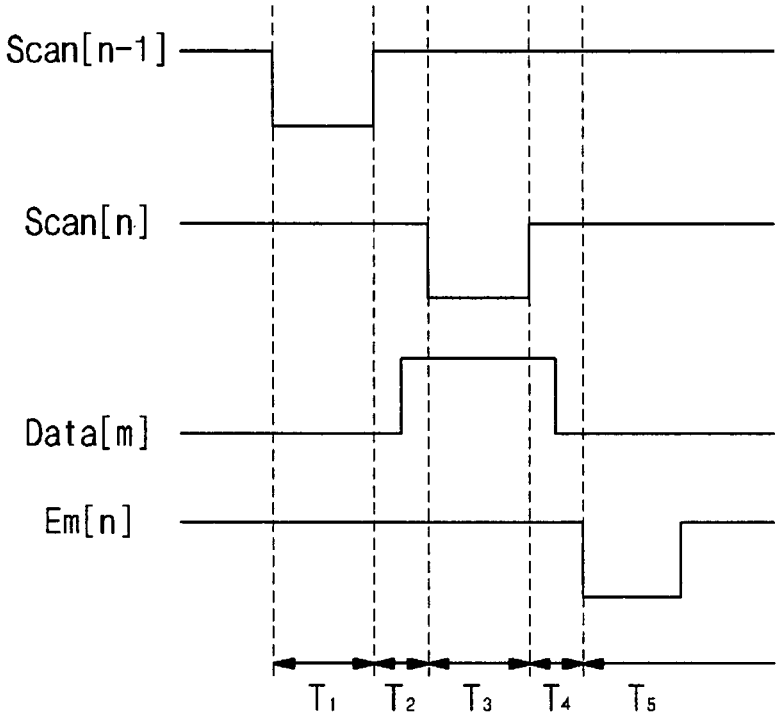
FIG. 8 is a timing diagram of the pixel circuit of FIG. 7.

FIG. 8 is a timing diagram of the pixel circuit of the organic light emitting display of FIG. 7. The timing diagram of FIG. 8 is nearly the same as the timing diagram of FIG. 6.

Referring to FIG. 8, the driving timing diagram of the pixel circuit of the organic light emitting display includes a current programming period (T1), a delay period 1 (T2), a programming period (T3), a delay period 2 (T4) and a light emitting period (T5).

For the current programming period (T1), a scan signal of a low level is supplied to the direct scan line (Scan[n-1]), so that the second to the fourth switching elements S2, S3 and S4 are turned on. The second switching element (S2) is turned on so that the driving transistor is connected in a diode configuration. The third switching element (S3) is turned on, so as to supply the first power supply voltage of the first power supply voltage line to the first electrode (A) of the first capacitive element (C1) and the first electrode (A) of the second capacitive element (C2). The fourth switching element (S4) is turned on, so as to cause the first current to flow to the driving transistor (M1). The first current ($I_{sink}$) is obtained by Equation 6.

$$\begin{aligned} I_{sink} &= \frac{\beta}{2}(V_{GS} - V_{TH})^2 = I_{OLED} \\ V_{GS} &= \sqrt{\frac{2I_{sink}}{\beta}} + V_{TH} \end{aligned} \quad \text{Equation 6}$$

In Equation 6, $V_{GS}$ is a voltage between the gate and the source of the driving transistor, $V_{TH}$ is a threshold voltage of the driving transistor, and β is a constant. A voltage value ($V_{GS}$) stored between the gate and the source of the driving transistor (M1) is defined by the first current ($I_{sink}$). Furthermore, a current flowing to the drain of the driving transistor (M1), i.e., a current flowing to the organic light emitting diode is controlled by the first current, so that the desired luminance may be obtained regardless of deviations in the mobility and threshold of respective transistors.

For the delay period 1 (T2), the scan signal of the scan line (Scan[n]) is maintained at a high level, a data voltage ($V_{DATA}$) of the data line (Data[m]) is changed into a data voltage ($V_{DATA}$) corresponding to the pixel circuit coupled to the scan line (Scan[n]). If there is no delay period 1 (T2), when a scan signal of the scan line (Scan[n]) reaches a low level prior to the supplying of a present data voltage ($V_{DATA}$), a direct data voltage supplied to the data line (Data[m]) is supplied to the driving transistor (M1) through the first switching element (S1).

For the programming period (T3), a scan signal of a low level of the scan line (Scan[n]) is supplied, the first switching element (S1) is turned on, so that a data signal is supplied to A node. A voltage variation of the A node is obtained by Equation 7.

$$\Delta V_A = V_{DATA} - V_{DD} \quad \text{Equation 7:}$$

In other words, the voltage of the A node is a difference between the voltage ($V_{DATA}$) for the programming period (T3) and the voltage ($V_{DD}$) for the current programming period (T1).

For the delay period 2 (T4), a scan signal of the scan line (Scan[n]) reaches a high level for a fixed time before a scan signal of the light emitting control line (Em[n]) reaches at a low level. This is for preventing a delay phenomenon occurring due to the delay of respective elements in the operation of the pixel circuit.

For the light emitting period (T5), a scan signal at a low level is supplied to the light emitting control line (Em[n]) and the fifth switching element (S5) is turned on, so that a voltage charged in the first capacitive element (C1) and the second capacitive element (C2), i.e., a current corresponding to the gate-source voltage ($V_{GS}$) of the driving transistor (M1) is supplied to the OLED so as to emit light. The current ($I_{OLED}$) is obtained by Equation 8.

$$I_{OLED} = \frac{\beta}{2}(VGS - \Delta V_G - V_{TH})^2 = \frac{\beta}{2}\left(\sqrt{\frac{2I_{sink}}{\beta}} + V_{TH} - \frac{C_1}{C_1 + C_2}(V_{DATA} - V_{DD}) - V_{TH}\right)^2 = \frac{\beta}{2}\left(\sqrt{\frac{2I_{sink}}{\beta}} - \frac{C_1}{C_1 + C_2}(V_{DATA} - V_{DD})\right)^2 \quad \text{Equation 6}$$

In Equation 8, $\Delta V_G$ is a gate voltage variation of the driving transistor (M1) according to the voltage variation ($V_{DATA}$–$V_{DD}$) of the A node, $V_{DATA}$ is a data voltage, $V_{DD}$ is a first power supply voltage, and $V_{TH}$ is a threshold voltage of the driving transistor (M1). Referring to Equation 5, the current ($I_{OLED}$) is controlled by the first power supply voltage ($V_{DD}$), the data voltage ($V_{DATA}$) and the first current ($I_{sink}$).

As described above, a driving circuit of a voltage programming technique compensates for deviations in the mobility and threshold of the driving transistors for the current programming period (T1), and programming and driving a data voltage for the programming period (T3). In other words, the driving circuit can compensate for the deviations in the mobility and threshold of the transistors that may occur from the voltage programming technique by first programming the current to the pixel circuit. Furthermore, the pixel circuit of a voltage programming technique programs a data voltage after programming the current to the pixel circuit, thereby reducing the time needed to charge the voltage in the capacitive element generated by the pixel circuit of the current programming technique. In other words, the disadvantages of the voltage programming technique and the current programming technique are obviated.

Figure 9:
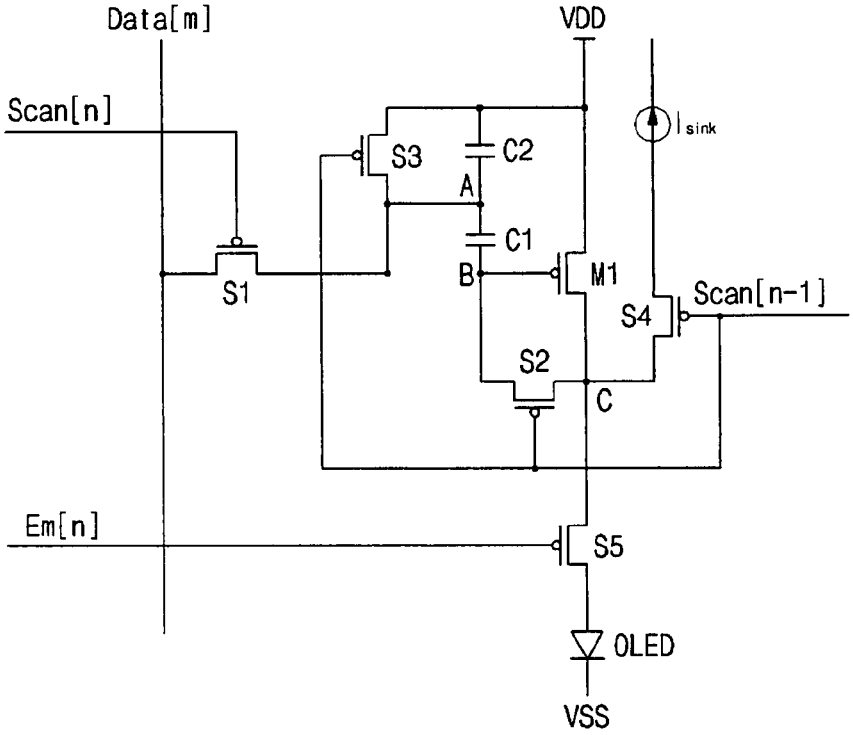
FIG. 9 is a circuit diagram of a pixel circuit of an organic light emitting display according to still another exemplary embodiment of the present invention.

FIG. 9 is a circuit diagram of a pixel circuit of an organic light emitting display according to still another exemplary embodiment of the present invention. The following pixel circuit corresponds to one pixel circuit of the flat panel display 100 of FIG. 4.

Referring to FIG. 9, the pixel circuit of the organic light emitting display has the same configuration as FIG. 5, except for the second capacitive element (C2). The second capacitive element (C2) includes the first electrode electrically coupled between the first power supply voltage line ($V_{DD}$) and the driving transistor (M1), and a second electrode electrically coupled between the first electrode of the first capacitive element (C1) and the second electrode of the third switching element (S3).

Figure 10:
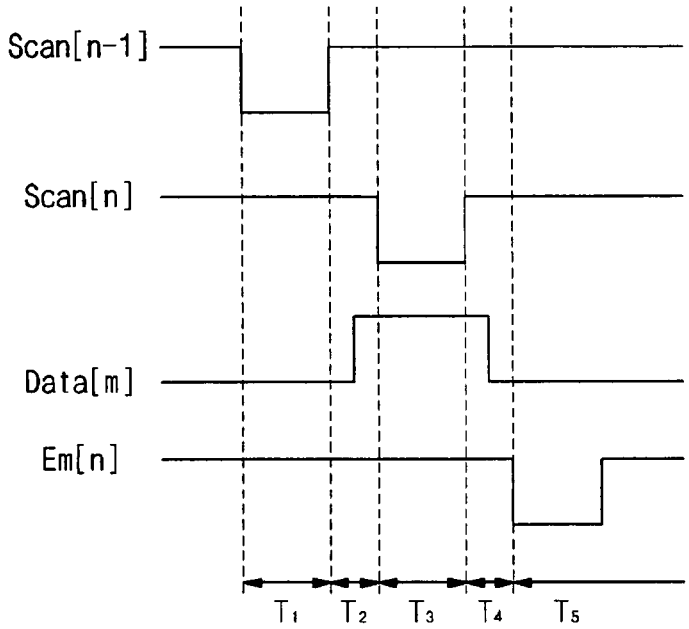
FIG. 10 is a timing diagram of the pixel circuit of FIG. 9.

FIG. 10 is timing diagram of a pixel circuit of the organic light emitting display of FIG. 9. The timing diagram of FIG. 10 is nearly the same as that of FIG. 6.

For the current programming period (T1), a scan signal of a low level is supplied to the direct scan line (Scan[n-1]), so that the second to the fourth switching elements (S2, S3 and S4) are turned on. The second switching element (S2) is turned on so that the driving transistor (M1) is connected in a diode configuration. The third switching element (S3) is turned on, so as to supply a first power supply voltage of the first power supply voltage line to the A node. The fourth switching element (S4) is turned on, so as to cause the first current to flow to the driving transistor (M1). The first current ($I_{sink}$) is obtained by Equation 9.

$$I_{sink} = \frac{\beta}{2}(V_{GS} - V_{TH})^2 = IOLED \quad \text{Equation 9}$$

$$V_{GS} = \sqrt{\frac{2I_{sink}}{\beta}} + V_{TH}$$

In Equation 9, $V_{GS}$ is a voltage between the gate and the source of the driving transistor (M1), $V_{TH}$ is a threshold of the driving transistor, and β is a constant. A voltage value ($V_{GS}$) to be stored in the gate and the source of the driving transistor (M1) may be estimated by the first current ($I_{sink}$). Furthermore, a current flowing to the driving transistor (M1), i.e., a current flowing to the organic light emitting display is controlled by the first current, so that the desired luminance maybe obtained regardless of deviations in the mobility and threshold of respective transistors.

For the delay period 1 (T2) a scan signal of the scan line (Scan[n]) is maintained at a high level, and a data voltage ($V_{DATA}$) of the data line (Data[m]) is changed into a data voltage ($V_{DATA}$) corresponding to the pixel circuit coupled to the scan line (Scan[n]). If there is no delay period 1 (T2), a scan signal of the scan line (Scan[n]) reaches a low level prior to the supplying of a present data voltage ($V_{DATA}$), and a direct data voltage supplied to the data line (Data[m]) is supplied to the driving transistor (M1) through the first switching element (S1).

For the programming period (T3), a scan signal at a low level of the scan line (Scan[n]) is supplied and the first switching element (S1) is turned on, so that a data signal is supplied to the A node. A voltage variation (T1→T3) of the A node is obtained by Equation 10.

$$\Delta V_A = V_{DATA} - V_{DD} \quad \text{Equation 10:}$$

In other words, a voltage of the A node is a difference between the voltage ($V_{DATA}$) for the programming period (T3) and the voltage ($V_{DD}$) for the current programming period (T1).

For the delay period 2 (T4), a scan signal of the scan line (Scan[n]) reaches a high level for a fixed time before a scan signal of the light emitting control line (Em[n]) reaches at a low level. This is for preventing a delay phenomenon that can occur due to the delay of respective elements in the operation of the pixel circuit.

For the light emitting period (T5), a scan signal of a low level is supplied to the light emitting control line (Em[n]), the fifth switching element (S5) is turned on, so that a voltage charged in the first and the second capacitive elements (C1 and C2), i.e., a current ($I_{OLED}$) corresponding to the gate-source ($V_{GS}$) of the driving transistor (M1) is supplied to the OLED so as to emit light. The current ($I_{OLED}$) is obtained by Equation 11.

$$I_{OLED} = \frac{\beta}{2}(V_{GS} - \Delta V_G - V_{TH})^2 \quad \text{Equation 11}$$

$$= \frac{\beta}{2}\left(\sqrt{\frac{2I_{sink}}{\beta}} + V_{TH} - (V_{DATA} - V_{DD}) - V_{TH}\right)^2$$

$$= \frac{\beta}{2}\left(\sqrt{\frac{2I_{sink}}{\beta}}\,(V_{DATA} - V_{DD})\right)^2$$

In Equation 11, $\Delta V_G$ is a gate voltage variation of the driving transistor (M1) according to the voltage variation ($V_{DATA}$–$V_{DD}$) of the A node, $V_{DATA}$ is a data voltage, $V_{DD}$ is the first power supply voltage, and $V_{TH}$ is a threshold voltage of the driving transistor. As shown in Equation 5, the current ($I_{OLED}$) is controlled, by the first power supply voltage ($V_{DD}$), the data voltage ($V_{DATA}$) and the first current ($I_{sink}$).

As shown above, the driving circuit is a voltage programming technique driven by compensating for the deviations in the mobility and threshold of the driving transistor (M1) for the current programming period (T1) and programming the data voltage for the programming period (T3). In other words, the driving circuit can compensate for the deviations in the mobility and threshold of the transistors that occur from the voltage programming technique by first programming the current to the pixel circuit. Furthermore, the pixel circuit of the voltage programming technique programs the data voltage after programming the current to the pixel circuit, thereby reducing the time needed to charge a voltage in the capacitive element from the pixel circuit of the current programming technique. In other words, the disadvantages of the voltage programming technique and the current programming technique are obviated.

As described above, the organic light emitting display according to the present invention produces the following effect.

First, the organic light emitting display rapidly charges the data voltage using the voltage programming technique, after compensating for a deviations in the mobility and threshold of the driving transistor using the current programming technique, thereby resulting in a high quality and high resolution display device.

It should be understood by those of ordinary skill in the art that various replacements, modifications and changes in the form and details may be made therein without departing from the spirit and scope of the present invention as defined by the following claims. Therefore, it is to be appreciated that the above described embodiments are for purposes of illustration only and are not to be construed as being limitations of the present invention.

What is claimed is:

1. An organic light emitting display, comprising:

a first switching element, having a control electrode thereof electrically coupled to a scan line, to transfer a data signal supplied by a data line;

a driving transistor, having a control electrode electrically coupled to the first switching element, to control a driving current of a first power supply voltage line;

a first capacitive element electrically coupled between the first switching element and the control electrode of the driving transistor;

an Organic Light Emitting Diode (OLED), electrically coupled between the driving transistor and a second power supply voltage line, to display an image in response to a current supplied by the driving transistor;

a third switching element electrically coupled between the first power supply voltage line and the first capacitive element; and a fourth switching element to supply a current of a first current line to the driving transistor, the current of the first current line compensating for deviations in characteristics of the driving transistor.

2. The organic light emitting display of claim 1, wherein the fourth switching element has a first electrode electrically coupled to the first current line, and a second electrode electrically coupled between the driving transistor and the OLED.

3. The organic light emitting display of claim 1, wherein deviations in characteristics of the driving transistor are compensated for by turning on the fourth switching element to supply a current from the first current line, and then turning on the first switching element to program a data voltage to the first capacitive element.

4. The organic light emitting display of claim 1, further comprising a second switching element to selectively connect the driving transistor in a diode configuration.

5. The organic light emitting display of claim 4, wherein the second switching element has a first electrode electrically coupled between the control electrode of the driving transistor and the first capacitive element, and a second electrode electrically coupled between the driving transistor and the fourth switching element.

6. The organic light emitting display of claim 1, wherein the third switching element has a first electrode electrically coupled to the first voltage line, and a second electrode electrically coupled between the first switching element and the first capacitive element.

7. The organic light emitting display of claim 1, further comprising a fifth switching element to transmit a current supplied by the driving transistor to the OLED.

8. The organic light emitting display of claim 7, wherein the fifth switching element has a first electrode electrically coupled between the driving transistor and the fourth switching element, and a second electrode electrically coupled to the OLED.

9. The organic light emitting display of claim 1, further comprising:

a second switching element to selectively connect the driving transistor in a diode configuration;

a third switching element to supply a voltage of the first voltage line to the first capacitive element; and a fifth switching element to transmit a current supplied by the driving transistor to the OLED.

10. The organic light emitting display of claim 9, wherein the second switching element has a first electrode electrically coupled between the control electrode of the driving transistor and the first capacitive element, and a second electrode electrically coupled between the driving transistor and the fourth switching element.

11. The organic light emitting display of claim 9, wherein the third switching element has a first electrode electrically coupled to the first voltage line, and a second electrode electrically coupled between the first switching element and the first capacitive element.

12. The organic light emitting display of claim 9, wherein the fifth switching element has a first electrode electrically coupled between the driving transistor and the fourth switching element, and a second electrode electrically coupled to the OLED.

13. The organic light emitting display of claim 9, wherein control electrodes of the second, third, and fourth switching elements are coupled to a direct scan line.

14. The organic light emitting display of claim 13, wherein the fifth switching element has a control electrode electrically coupled to a light emitting control line.

15. The organic light emitting display of claim 14, wherein the first, second, third, fourth, and fifth switching elements and the driving transistor each comprise a P-channel transistor.

16. The organic light emitting display of claim 14, wherein, for a compensation period in an image display period of one frame, the current from the first current line is supplied to the driving transistor to compensate for a threshold voltage of the driving transistor in response to the second and third and fourth switching elements being turned on and the first and fifth switching elements being turned off.

17. The organic light emitting display of claim 14, wherein, for a programming period in the image display period of one frame, a data voltage from the data line is supplied to the first electrode of the first capacitive element in response to the second, third, fourth, and fifth switching elements being turned off.

18. The organic light emitting display of claim 14, wherein for a light emitting period in the image display period of one frame, a voltage stored in the first capacitive element is supplied to the OLED to emit light in response to the fifth switching element being turned on, and the first, second, third, and fourth switching elements being turned off.

19. The organic light emitting display of claim 9, further comprising a second capacitive element having a first electrode electrically coupled between the first voltage line and the third switching element, and a second electrode electrically coupled between the first capacitive element and the control electrode of the driving transistor.

20. The organic light emitting display of claim 19, wherein control electrodes of the second, third, and fourth switching elements are coupled to the direct scan line, and a control electrode of the fifth switching element is coupled to the light emitting control line.

21. The organic light emitting display of claim 9, further comprising a second capacitive element having a first electrode electrically coupled between the first voltage line and the first electrode of the third switching element, and a second electrode electrically coupled between the first capacitive element and the second electrode of the third switching element.

22. The organic light emitting display of claim 21, wherein control electrodes of the second, third, and fourth switching elements are electrically coupled to the direct scan line, and the control electrode of the fifth switching is electrically coupled to the light emitting control line.

* * * * *